US007575700B2

(12) United States Patent
Ishler

(10) Patent No.: US 7,575,700 B2
(45) Date of Patent: Aug. 18, 2009

(54) APPARATUS AND METHOD FOR A MOLD ALIGNMENT SYSTEM

(75) Inventor: Vincent Ishler, Mercersburg, PA (US)

(73) Assignee: Pampf Molds Industries, Inc., Hagerstown, MD (US)

( * ) Notice: Subject to any disclaimer, the term of this patent is extended or adjusted under 35 U.S.C. 154(b) by 0 days.

(21) Appl. No.: 11/359,770

(22) Filed: Feb. 23, 2006

(65) Prior Publication Data

US 2006/0197259 A1 Sep. 7, 2006

Related U.S. Application Data

(60) Provisional application No. 60/656,894, filed on Mar. 1, 2005.

(51) Int. Cl.
*B28B 3/04* (2006.01)
*B28B 1/087* (2006.01)

(52) U.S. Cl. ..... 264/71; 264/297.9; 425/421; 425/432

(58) Field of Classification Search ..... 425/253, 425/412, 421, 422, 452, 432; 264/319, 334, 264/333, 71, 297.9
See application file for complete search history.

(56) References Cited

U.S. PATENT DOCUMENTS

| | | | | | |
|---|---|---|---|---|---|
| 805,914 | A | | 11/1905 | Horr | |
| 813,592 | A | | 2/1906 | Schou | |
| 2,075,992 | A | * | 4/1937 | Lux et al. | 425/432 |
| 2,339,792 | A | * | 1/1944 | Milano | 425/395 |
| 2,479,350 | A | * | 8/1949 | Haggart, Jr. | 425/412 |
| 2,869,179 | A | * | 1/1959 | Van Hartesveldt | 425/398 |
| 2,887,755 | A | * | 5/1959 | Zevely | 425/444 |
| 3,593,373 | A | * | 7/1971 | Loomis | 425/432 |
| 3,694,128 | A | | 9/1972 | Foxen | |
| 3,932,098 | A | * | 1/1976 | Huber et al. | 425/412 |
| 3,940,229 | A | | 2/1976 | Hutton | |
| 4,179,258 | A | * | 12/1979 | Karas et al. | 425/432 |
| 4,235,580 | A | * | 11/1980 | Springs et al. | 425/413 |
| 4,407,766 | A | | 10/1983 | Haardt et al. | |
| 4,421,471 | A | * | 12/1983 | Vogt | 425/432 |
| 4,545,754 | A | | 10/1985 | Scheidt et al. | |
| 4,735,562 | A | | 4/1988 | Boutillier | |
| 4,941,813 | A | * | 7/1990 | Grubb et al. | 425/253 |
| 5,078,940 | A | | 1/1992 | Sayles | |
| 5,217,630 | A | | 6/1993 | Sayles | |
| 5,445,514 | A | | 8/1995 | Heiz | |
| 5,533,885 | A | | 7/1996 | Schlusselbauer | |
| 5,879,603 | A | | 3/1999 | Sievert | |
| 5,943,827 | A | | 8/1999 | Okerlund | |

(Continued)

FOREIGN PATENT DOCUMENTS

CA 2 463 194 A1 10/2004

(Continued)

*Primary Examiner*—James Mackey
(74) *Attorney, Agent, or Firm*—Howrey LLP

(57) ABSTRACT

An embodiment generally relates to a guidance system for aligning a tamperhead and a mold in the production of concrete products. The guidance assembly includes an alignment element mounted on the tamperhead and a bushing configured on a flange of the mold. The alignment element is configured to engage with the bushing in response to movement of the tamperhead towards the mold, bringing the plungers and stripper shoes of the tamperhead into alignment with the mold cavities in the mold.

10 Claims, 4 Drawing Sheets

U.S. PATENT DOCUMENTS

| | | | |
|---|---|---|---|
| 6,113,379 | A | 9/2000 | LaCroix et al. |
| 6,138,983 | A | 10/2000 | Sievert |
| 6,209,848 | B1 | 4/2001 | Bolles et al. |
| 6,224,815 | B1 | 5/2001 | LaCroix et al. |
| 6,280,566 | B1 | 8/2001 | Naito et al. |
| 6,464,199 | B1 | 10/2002 | Johnson |
| 6,488,491 | B1 | 12/2002 | Nelson et al. |
| 6,530,769 | B1 | 3/2003 | Rondeau et al. |
| 6,764,294 | B2 | 7/2004 | Saddler |
| 7,140,867 | B2 | 11/2006 | Scherer et al. |
| 7,291,306 | B2 | 11/2007 | Ishler |
| 2002/0025357 | A1 | 2/2002 | Spangenberg et al. |
| 2003/0164574 | A1 | 9/2003 | Hammer et al. |
| 2005/0116389 | A1 | 6/2005 | Hammer et al. |

FOREIGN PATENT DOCUMENTS

| | | | |
|---|---|---|---|
| DE | 2937704 | | 3/1981 |
| DE | 43 36 744 | * | 5/1995 |
| DE | 2530098 | | 1/1997 |
| DE | 19546745 | | 6/1997 |
| DE | 19634499 | | 3/1998 |
| DE | 19639640 | | 4/1998 |
| GB | 2216839 | * | 10/1989 |
| JP | 2001191314 A | | 7/2001 |

* cited by examiner

APPARATUS AND METHOD FOR A MOLD ALIGNMENT SYSTEM

RELATED U.S. APPLICATIONS

This application claims the benefit of U.S. provisional application No. 60/656,894 filed Mar. 1, 2005 and entitled "Apparatus and Method for a Mold Alignment System." The foregoing application is hereby incorporated herein by reference.

FIELD OF INVENTION

The invention generally relates to concrete-based product making machinery. More particularly, the invention relates to an apparatus and method for aligning a tamperhead with a mold in a mold assembly.

BACKGROUND OF THE INVENTION

Concrete masonry units are typically produced using a production machine and a mold assembly. Generally, the mold assembly includes a mold having mold cavities and a tamperhead. The production machinery may drive the tamperhead into the mold to strip formed and compacted concrete products from the mold cavities.

The tamperhead may be composed of several sub-components which may include an upper head structure, a plunger and a stripper shoe. Multiple sets of stripper shoes and plungers may be connected to a single head structure and may be used to strip multiple masonry units from one or more molds or a set of concrete mold cavities. The plungers are commonly fabricated in structural shapes, depending on the shape and type of concrete units being formed. Plungers typically include a rigid material such as steel and are welded on one end to the head structure and on the other end to the stripper shoe. The plungers provide the structural load path to compress the concrete and strip the formed concrete product from the mold.

Upon filling the mold with concrete, the tamperhead may be lowered until the stripper shoes enter the mold cavities and contact the concrete. However, the stripper shoes and the mold cavities must be particularly aligned. In previous systems, this alignment process may inflict significant wear and stress on both the mold and tamperhead, resulting in increased production time and cost.

By design, a stripper shoe mounted on a tamperhead needs to fit a respective mold cavity with a minimal clearance. Depending on the type and size of product being manufactured, this clearance may range from 0.20 mm to 1.50 mm per side. If the clearance is too small, the shoe will abrade against the cavity wall, thereby inducing stress in the mold and production machinery as well as premature wear on the machinery. If the clearance is too large, concrete will extrude between the shoe and the cavity walls, forming "burrs" on top of the product which, at best, detract from its aesthetic appeal and, at worst, create installation problems in the field.

Typically, the production machinery is incapable of guiding the tamperhead and the mold within the exacting minimal clearance required. As a result, prior machines have included a leading angle on the top edge of the mold cavities. This leading angle may serve as a default guidance and alignment mechanism. The alignment of the stripper shoes with the mold cavities occurs, contemporaneously with the lowering of the tamperhead, when the leading angle on the mold cavities forces and guides the stripper shoes into the openings of the mold.

The demands and economics of the concrete product production industry result in the need to run the production machinery at high speeds and high volumes. As a consequence, a stripper shoe may impact the leading edge of a mold cavity repeatedly and at high impact forces. The impact of the stripper shoe on the leading edge varies from one machine to another because different production machines use different systems to drive a compression beam. For example, some production machines use a hydraulic system while others use a mechanical system at varying speeds and vibration frequencies. Moreover, the operator of the machines may vary the speed of the compression beam as the produced concrete products may require. Nevertheless, this impact causes significant forces and vibrations in the mold cavities and in the tamperhead. These impact forces and vibrations are considered a significant factor in the failure of tamperheads and, more particularly, in the failure of plungers. Furthermore, severe impacts between the stripper shoes and the mold may cause significant damage to the mold and, in some cases, may result in catastrophic failure of the mold by crushing the thin walls separating the individual mold cavities.

While the tamperhead and the mold cavities may be initially aligned during insertion of the tamperhead and the mold into the production machinery, this alignment is not sufficient once the machinery is used for production of concrete products. The forming process includes vibrating or shaking of the mold assembly with a vibration system as the concrete is compacted. This vibration system spreads the concrete material evenly within the mold assembly cavities to produce a more homogeneous concrete product and assist in compacting the concrete product. Unfortunately, vibrations of the mold assembly transfer forces and stresses to the tamperhead and mold cavities, thereby causing small variations in the position of the production machinery. These vibrations typically occur approximately every eight to fifteen seconds during a typical production cycle depending on the type of concrete product being formed.

Unfortunately, the repeated forces transmitted by the alignment impact forces and vibrations makes the plunger and joints in the tamperhead susceptible to material fatigue failure and cause wear and stress on the mold. As a result of the combined stresses and wear, expensive plungers typically last for only a short period of time and must be replaced at great expense and loss of production time. Likewise, damaged mold cavities must be replaced or repaired, requiring significant and costly machining.

Therefore, there exists a need for a tamperhead and mold that repeatedly aligns itself during each production cycle, thereby reducing the resultant fatigue stresses and wear from repeated alignment impacts.

SUMMARY OF THE INVENTION

The invention generally relates to concrete-based product making machinery. More particularly, the invention relates to an apparatus and method for aligning a tamperhead with a mold in a mold assembly.

In one embodiment of the present invention, a production apparatus for producing molded products may include a mold having at least one mold cavity and a tamperhead having at least one plunger, said tamperhead being positioned substantially above said mold and being movable towards said mold. The apparatus may also include a wearable, replaceable alignment element attached to one of said tamperhead and said mold and a wearable, replaceable bushing attached to the other of said tamperhead and said mold. Additionally, said bushing may be configured to engage with said alignment element prior to the at least one plunger engaging with the at least one mold cavity when said tamperhead is moved towards said mold.

In yet another embodiment of the present invention, a method for producing molded products may include the steps of moving a tamperhead having at least one plunger towards a mold having at least one mold cavity, engaging a wearable, replaceable alignment element attached to one of the tamperhead and the mold with a wearable, replaceable bushing attached to the other of the tamperhead and the mold and engaging the at least one plunger with the at least one mold cavity when the tamperhead is moved towards the mold. The step of engaging the alignment element with the bushing may occur prior to the step of engaging the at least one plunger with the at least one mold cavity. Further, the engagement of the alignment element with the bushing may move the at least one plunger into substantial alignment with the at least one mold cavity.

One advantage of the system of the present invention is that it may direct the destructive guiding forces that occur in conventional mold designs to the integral guiding system of the present invention. As a result, stripper shoe wear may be decreased because of the lack of collisions between the stripper shoes and the leading angle of the mold cavity. Likewise, tamperhead failures may be reduced as a result of the diminished stress on the joint between the plungers and the upper head structure.

Mold cavity life may also be extended by forcing correct alignment and proper clearance between stripper shoes and cavity walls during entry of the stripper shoe into the mold cavities. Furthermore, catastrophic failure of the mold cavity caused by gross misalignment between a tamperhead and a mold bottom may be avoided by aligning the stripper shoes with the mold cavities before entry.

The guidance system of the present invention may also serve as a visual aid for a machine operator during the set-up phase of the production cycle. Even if a mold is poorly installed and/or operated under poor conditions, the guidance system may prevent premature mold wear where conventional guiding systems are no longer adequate. By aiding in the installation and repeatedly aligning the tamperhead during production cycles, the system of the present invention may reduce wear on the mold assembly and/or production machinery, thereby reducing the need for maintenance and replacement.

Although the leading angles on the top edge of the mold cavities may be maintained as a default guidance system, embodiments of the present invention may also substantially reduce the cost in the manufacturing process by eliminating the leading angle chamfer as an alignment system in conventional molds. Likewise, the guidance system of the present invention does not require modification of production machinery to function and may be incorporated into each individual preexisting mold. Even as mold assemblies are changed out in the production machinery, each mold assembly may operate with its own guidance system. Therefore, the system of the present invention may be used to fabricate concrete product mold assemblies that will last longer and operate more reliably throughout their entire lifespan.

These and other objects and advantages of the invention will be apparent from the following description, the accompanying drawings and the appended claims.

BRIEF DESCRIPTION OF THE DRAWINGS

While the specification concludes with claims particularly pointing out and distinctly claiming the present invention, it may be believed the same will be better understood from the following description taken in conjunction with the accompanying drawings, which illustrate, in a non-limiting fashion, the best mode presently contemplated for carrying out the present invention, and in which like reference numerals designate like parts throughout the figures, wherein:

DETAILED DESCRIPTION OF THE INVENTION

For simplicity and illustrative purposes, the principles of the present invention are described by referring mainly to exemplary embodiments thereof. However, one of ordinary skill in the art would readily recognize that the same principles are equally applicable to, and can be implemented in, many types of machines that produce products by molds, and that any such variations do not depart from the true spirit and scope of the present invention. Moreover, in the following detailed description, references are made to the accompanying figures, which illustrate specific embodiments. Electrical, mechanical, logical and structural changes may be made to the embodiments without departing from the spirit and scope of the present invention. The following detailed description is, therefore, not to be taken in a limiting sense and the scope of the present invention is defined by the appended claims and their equivalents.

Figure 1:
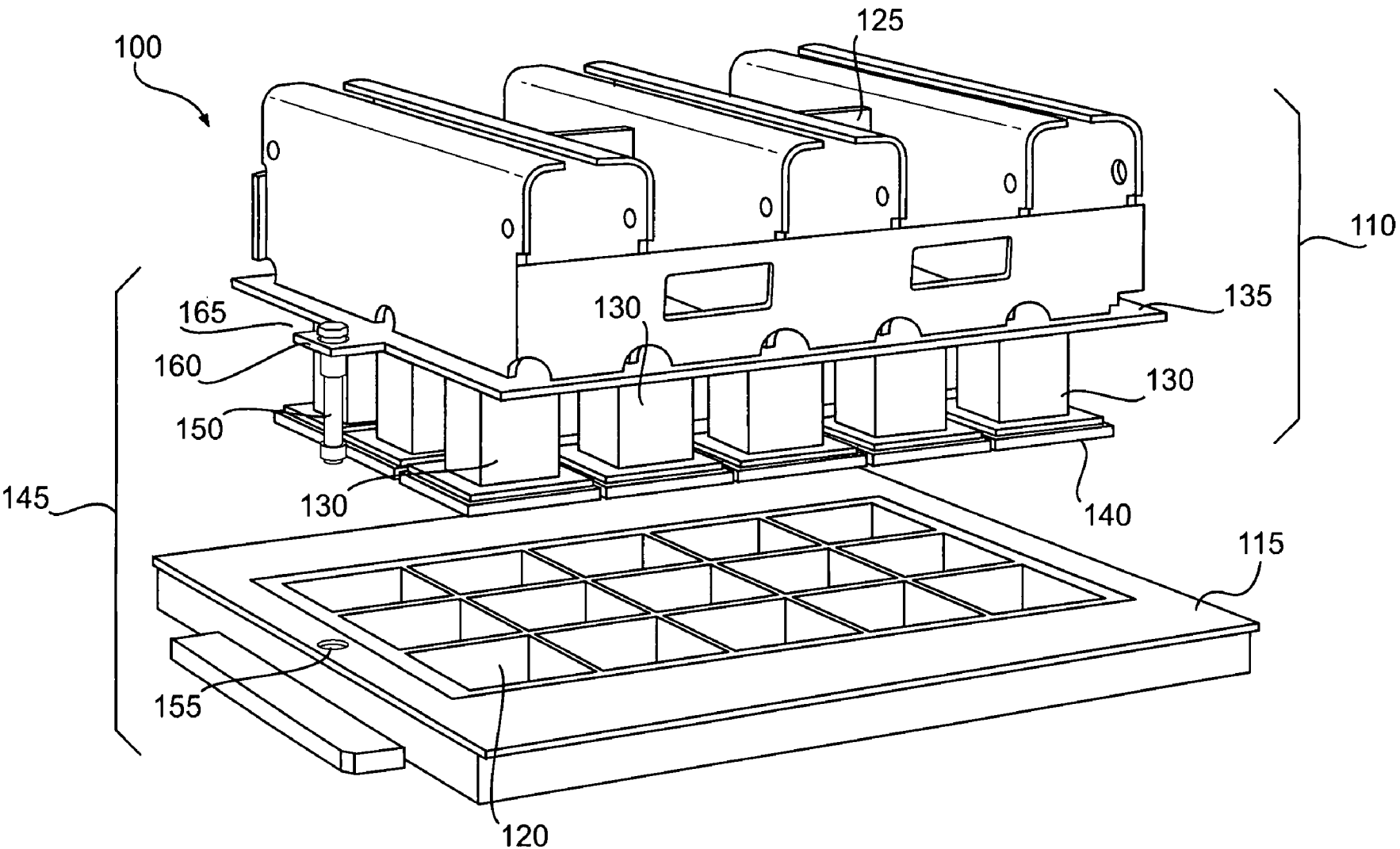
FIG. 1 illustrates a system in accordance with one embodiment of the present invention.

FIG. 1 illustrates a mold assembly 100 in accordance with one embodiment of the present invention. It should be readily apparent to those of ordinary skill in the art that the embodiment 100 depicted in FIG. 1 represents a generalized schematic illustration and that other components may be added or existing components may be removed or modified.

Referring to FIG. 1, the mold assembly 100 may include a tamperhead 110 and a mold bottom 115. The mold bottom 115 may comprise multiple mold cavities 120. Although illustrated in a box-like configuration, it is contemplated that each mold cavity 120 may also be configured in differing shapes and sizes depending on the shape and size of the desired concrete product. The mold bottom 115 is generally adapted to fit on a mold die support and is sized to fit on a vibrating table of the production machine. While the mold bottom 115 is typically constructed from a rigid dense material (for example, heavy grade steel), it is contemplated that any material sufficient to withstand the vibration and forces associated with the production machinery for concrete products may be used.

The tamperhead 110 may include a mold head superstructure 125. As discussed above, the mold head superstructure 125 may be configured to attach to a compression beam of the production machinery. The tamperhead 110 may also include plungers 130 attached to a structure plate 135. The plungers 130 may be welded onto the structure plate 135 or may be attached using any means known in the art for rigidly attaching two machine elements. The plungers 130 are generally constructed from any heavy rigid material (for example, carbon steel) sufficient to withstand the forces associated with the production process of concrete products.

Stripper shoes 140 may be attached to the opposite end of the plungers 130. Each stripper shoe 140 may be welded onto its respective plunger 130 or may be attached using any means known in the art for rigidly attaching two machine elements. Each stripper shoe 140 may also be configured to substantially fill the space of the mold cavity 120 positioned directly below it in order to strip formed concrete products from the respective mold cavity 120.

In accordance with the present invention, the mold assembly 100 includes a guidance system 145. The guidance system 145 may be configured to align each of the stripper shoes 140 with the mold cavities 120 located directly below without exerting undue force on the stripper shoes 140. In one embodiment of the present invention, a mold assembly 100 may be manufactured so as to include the guidance system 145 of the present invention. In alternative embodiments, preexisting mold assemblies and machinery may be modified so as to incorporate the guidance system 145 of the present invention. The method for attaching the guidance system 145 of the present invention to preexisting machinery so that the guidance system 145 operates in the same manner described below would be known to one of skill in the art in light of the present disclosure.

According to one embodiment of the present invention, the guidance system may include a replaceable, wearable alignment element, a replaceable, wearable bushing for receiving the alignment element and a support structure for attaching the alignment element to the machinery. In the exemplary embodiment of the present invention illustrated in FIG. 1, the alignment element 150 may be in the form of a round alignment pin. However, as will be known to one of skill in the art, the alignment element may also be in the form of any shape including, but not limited to, a rectangular or a wedge shape.

Further, the guidance system 145 may include a bushing 155 configured to receive the alignment element. In the embodiments illustrated in the FIGS., the bushing 155 may be in the form of a rounded, elongated bushing for receiving an alignment pin 150. However, as will also be known to one of skill in the art, the bushing may be of any size and shape as long as it is capable of receiving the alignment element in the manner discussed in greater detail below.

Additionally, the embodiment illustrated in FIG. 1 includes a support structure 160 (to which the alignment element 150 may be attached) and a pin-retaining bolt 165 for attaching the alignment element 150 to the support structure 160. However, as will be known to one of skill in the art, the alignment element 150 may also be attached to preexisting machine structure without requiring a dedicated support structure 160. Further, while FIG. 1 illustrates the use of a retaining bolt 165, any means for attaching known in the art may be used for attaching the alignment element 150 to the support structure 160 or machinery. This may include, but is not limited to, conventional screws, pins, straps, glue or welding.

Finally, while the guidance system 145 shown in the figures illustrates the alignment element 150 attached to the tamperhead 110 and the bushing 155 attached to the mold 115, it is contemplated that the alignment element 150 and the bushing 155 may be reversed. More specifically, it is contemplated that the alignment element 150 may be attached to the mold 115 and the bushing may be attached to the tamperhead 110.

Figure 2:
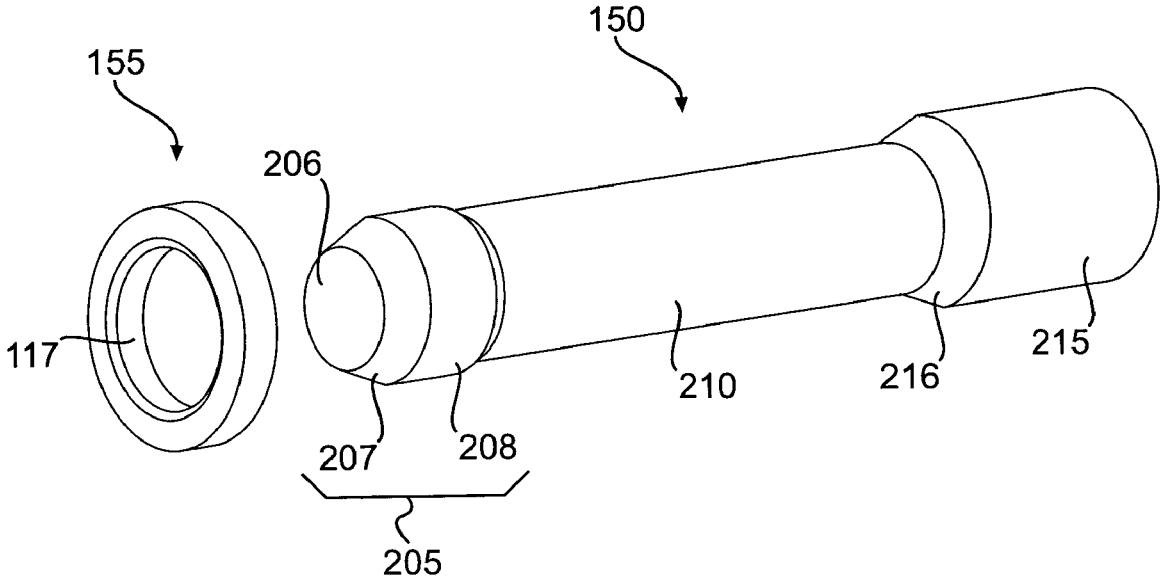
FIG. 2 illustrates a detailed guidance system in accordance with another embodiment of the present invention.

In the embodiment of the invention illustrated in FIG. 2, the alignment element 150 is illustrated as an alignment pin having a self-guiding nodule 205, a neck 210, and a base 215. Of course, the alignment element 150 may also be formed so that either end comes to a point or is rounded, depending on the overall shape of the alignment element. Further, the alignment element 150 may be formed so that one or both of the nodule and base have the same diameter as the neck portion.

In the embodiment of the present invention shown in FIG. 2, the self-guiding nodule 205 may be configured to be substantially planar on one end 206. The self-guiding nodule 205 illustrated in may also include a beveled portion 207. As discussed in greater detail below, this bevel may serve to move the alignment element 150 into the bushing 155 when the tamperhead 110 is not aligned with the mold 115. Because of the bevel, the alignment element may be gradually forced into the bushing in the event that the beveled portion makes contact with the side of the bushing.

As discussed above, the alignment element 150 may be formed having any cross-sectional shape as long as the functionality of the present invention is retained. For example, where alignment in only one linear direction is desired, the alignment element 150 may be shaped as a wedge, with a bevel on each of two sides. Further, where alignment is desired in two perpendicular directions, the alignment element may have a rectangular cross section, with a bevel on four sides. Additionally, where alignment is desired in any direction, the alignment element may have a circular cross-section, as illustrated in FIG. 2.

In one embodiment, the bevel may be 45 degrees. In other embodiments, the bevel may be less than 45 degrees, which may provide for optimal guidance functions. In yet other embodiments, the beveled portion 207 may be greater than 45 degrees as long as the bushing 155 is also beveled. As would be known to one of skill in the art, the necessary length of the beveled portion 207 is dependent on the angle of the beveled portion and the size of the guiding device. The beveled portion 207 may be substantially minimal, thus providing minimal alignment function. Conversely, the beveled portion 207 may be as large as would be desirable. Obviously, as the beveled portion is made to be larger, the greater the amount of alignment and correction provided by the device.

In one embodiment, the self-guiding nodule 205 may also include a cylindrical portion 208. The length of the cylindrical portion may be dependent on the size of the mold 115 and/or depth of the mold cavities 120. The cylindrical portion 208 may be configured to fill the bushing 155 within a minimal clearance. In certain embodiments, the clearance may be a function of the shoe to cavity distance. In other embodiments, and as discussed above, the cylindrical portion may have the same diameter as the rest of the alignment element 150. In any embodiment, the clearance may be sized to fit depending on the demands of the application.

The length of the neck portion 210 may be dependent on the size of the mold 115 and/or depth of the mold cavities 120. More particularly, the length of the neck 210 may be dependent on the height of the tamperhead 110 as well as the height of the concrete product desired. This height may also be a function of the particular production machinery in which the present invention is to be incorporated.

The diameter of the neck portion 210 may be sized appropriately so as to provide a clearance within the bushing 155 and may be a function of the structural requirements and physical limitations of the production machinery. The clearance may be configured to provide the tamperhead 110 freedom of motion during the vibration phase of concrete product production.

The base portion 215 of the alignment element 150 may also be substantially cylindrical, as illustrated in FIG. 2. The base portion 215 may include a base chamfer 216. In one embodiment, the chamfer of the base chamfer 216 may be set at 45 degrees. However, the base chamfer 216 may be determined by a user as this chamfer should be configured to eliminate the effects of a sharp corner (a sharp corner tends to concentrate stress during vibration and impact loading).

The bushing 155 may be situated on a flange piece of the mold bottom 115. As discussed above, the bushing 155 may be formed in any shape as long as it is capable of receiving the alignment element 150. In the embodiment illustrated in FIG. 2, the bushing 155 may be configured to be substantially circular with an interior chamfered edge 117 and may be configured to be placed in a hole in the production machinery. In other embodiments, the bushing may be separately attached to the production machinery in a similar manner as discussed above with respect to the support structure 160 for the alignment element 150.

The upper portion of the bushing that is exposed on the flange may also be chamfered. The bushing 155 may be configured to have a diameter which is a function of the space requirements and the number of guiding devices used. In other words, the larger the number of guiding devices, the smaller the diameter of the bushing that may be necessary. The bushing 155 may be implemented using any rigid material known to one of skill in the art, such as carbon steel. In other embodiments, the bushing 155 may be integrally formed with the flange piece of the mold bottom using etching or abrading techniques known to those skilled in the art. In yet other embodiments, the bushing may be a hole located in the production machinery.

The operation of the guidance system 145 of the present invention will now be described with reference to FIGS. 3-7. It should be noted that use of the guidance system 145 of the present invention may serve to extend the life of production machinery used in the production of concrete products. As discussed above, the bushing 155 and alignment element 150 may be designed to absorb the repeated impact forces present during alignment of a tamperhead 110 with a mold. Because the bushing 155 and alignment element 150 are replaceable, as they become worn out due to the repeated impact forces, they may be replaced at a relatively low cost. This allows the life of the expensive production machinery to be extended and reduces the overall cost of operation of the mold assembly.

Figure 3:
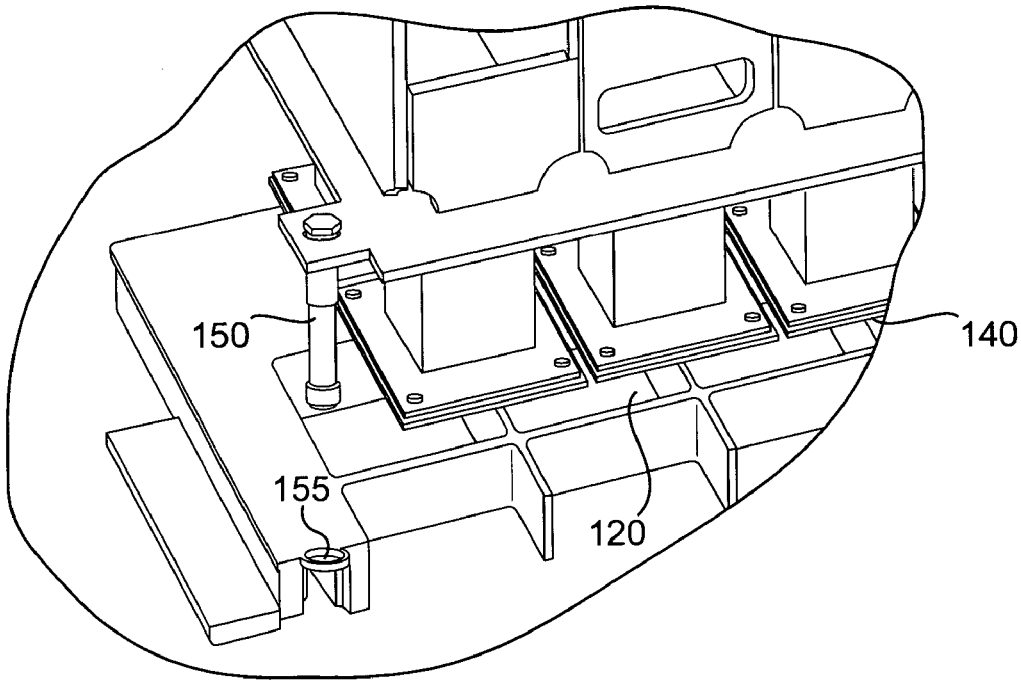
FIG. 3 illustrates a guidance system in accordance with another embodiment of the present invention.

In FIG. 3, the tamperhead 110 is shown in an elevated position above the mold bottom 115 prior to the tamperhead being lowered towards the mold. As a result of this positioning, the alignment element 150 is disengaged from the bushing 155. As discussed above, the length of the alignment element 150 may be a function of the length of the plungers 130 and stripper shoes 140. Thus, the length of the alignment element 150 should be large enough to engage the bushing 155 prior to the stripper shoes 140 entering the respective mold cavities of the mold bottom 115.

During movement of the tamperhead towards the mold bottom, if the stripper shoes are not aligned with the mold cavities, the beveled portion 207 of the alignment element 150 may engage the chamfered edge 117 of the bushing 155 and guide the alignment element 150 into the bushing 155 prior to the entry of the stripper shoes 140 into their respective mold cavities 120. When the alignment element 150 is substantially within the bushing 155, the tamperhead 110 and the mold bottom 115 are substantially aligned within required tolerances. Thus, the stripper shoes 140 may enter the mold cavities with minimal damage. FIGS. 4-7 illustrate the alignment pin 150 entering the bushing 155 in this manner.

Figure 4:
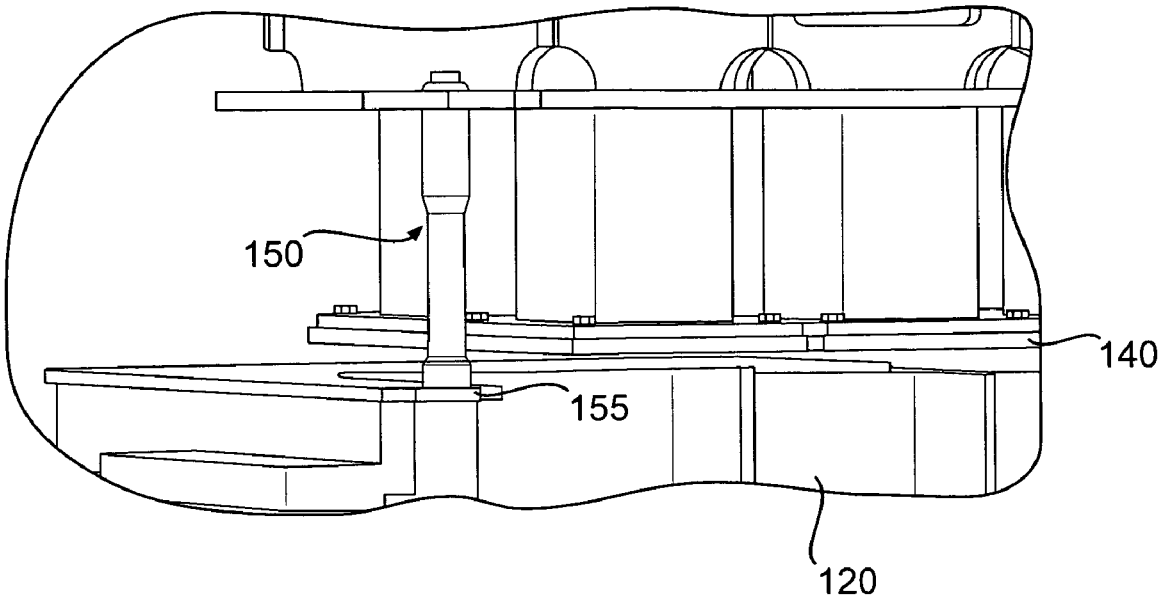
FIG. 4 illustrates a side elevation view of the guidance system according to one embodiment of the present invention.
Figure 5:
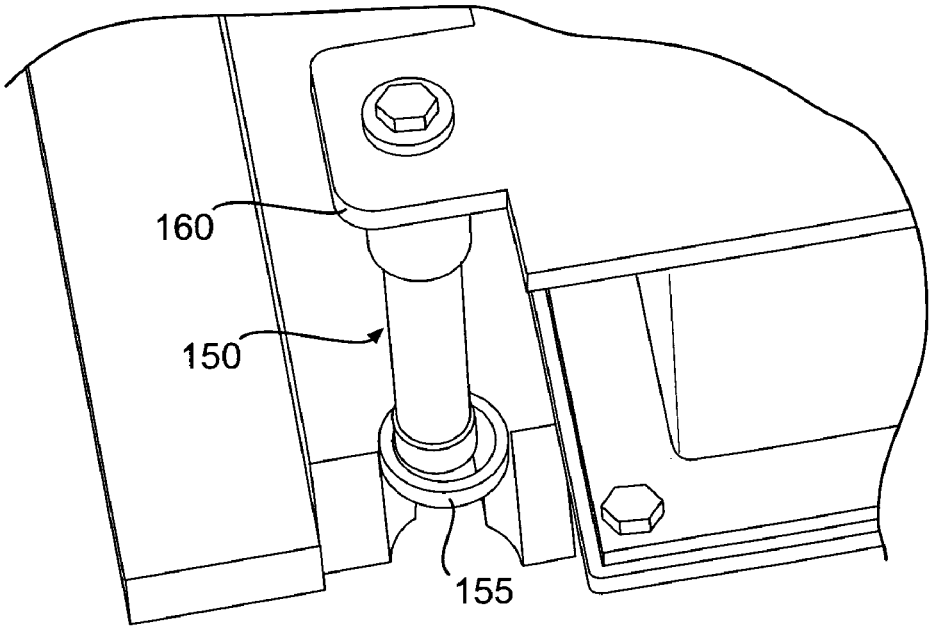
FIG. 5 illustrates a cut away view of the guidance system according to one embodiment of the present invention.
Figure 6:
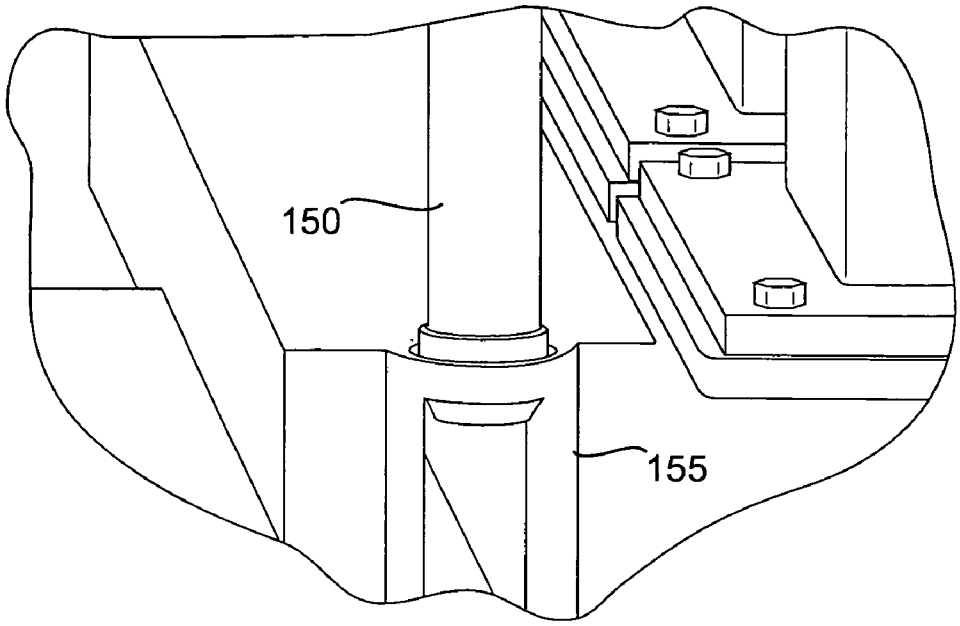
FIG. 6 illustrates a fully engaged pin of the guidance system in accordance with one embodiment of the present invention.

Specifically, FIG. 4 illustrates a cut away view of the alignment element 150 engaging the bushing 155 prior to entry of the stripper shoes 140 into the mold cavities 120. FIG. 5 illustrates the beveled portion 207 of the alignment pin 150 engaging with the chamfered edge 117 of the bushing 155. In FIG. 5, the tamperhead 110 is illustrated as being offset from the mold cavities 120. As such, the beveled portion 207 may engage with the upper chamfered portion 117 of the bushing 155 and may serve to force the tamperhead into alignment by forcing the alignment element 150 into the bushing 155. FIG. 6 illustrates an alignment element 150 fully engaged with the bushing 155, with the tamperhead 110 being aligned with the mold cavities 120 below.

Figure 7:
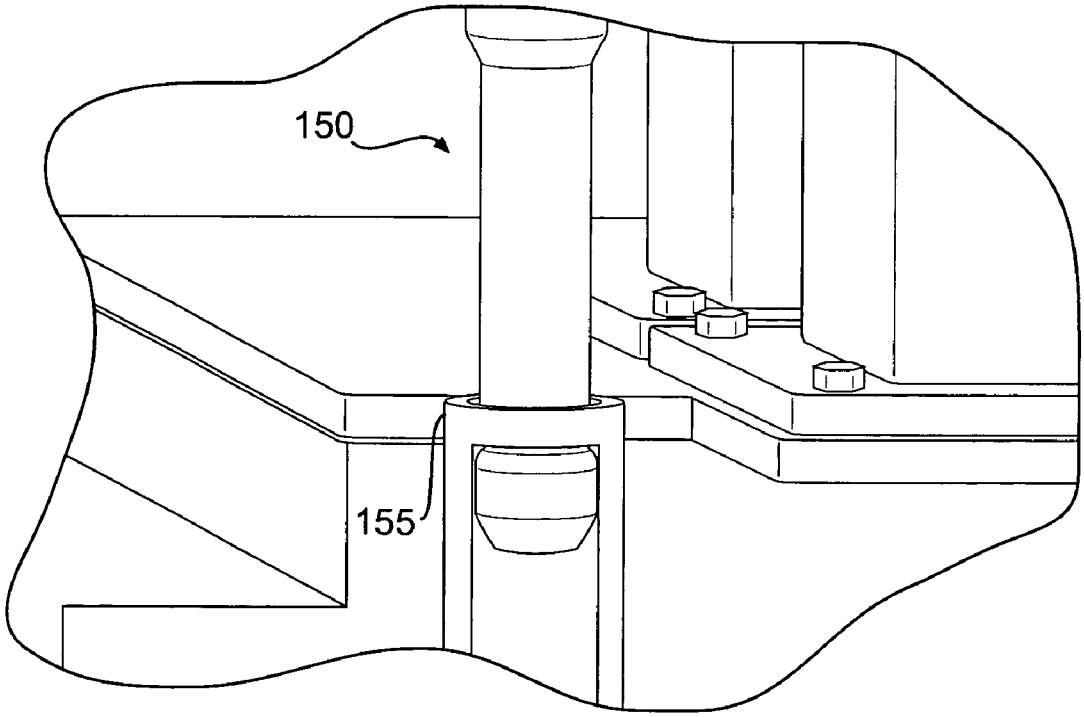
FIG. 7 illustrates a disengaged pin of the guidance system in accordance with one embodiment of the present invention.

As the tamperhead 110 continues to lower towards the mold cavities 120, the neck portion 210 of the alignment element 150 may be lowered through the bushing 155, as illustrated in FIG. 7. In one embodiment, the reduced diameter of the neck portion 210 of the alignment element 150, compared to the self-guiding nodule 205, may provide additional clearance in the event of any vibration events that may occur during the production process.

While the invention has been described with reference to the exemplary embodiments thereof, those skilled in the art will be able to make various modifications to the described embodiments without departing from the true spirit and scope. The terms and descriptions used herein are set forth by way of illustration only and are not meant as limitations. In particular, although the method has been described by examples, the steps of the method may be performed in a different order than illustrated or simultaneously. Those skilled in the art will recognize that these and other variations are possible within the spirit and scope as defined in the following claims and their equivalents.

What is claimed is:

1. A production apparatus for producing molded products, the apparatus comprising:

a vibratable mold having at least one mold cavity;

a tamperhead having at least one plunger, said vibratable mold being positionable substantially below said tamperhead and said tamperhead being movable towards said vibratable mold;

a wearable, replaceable guiding element attached to one of said tamperhead and said vibratable mold; and a wearable, replaceable bushing attached to the other of said tamperhead and said vibratable mold;

wherein said guiding element aligns with said bushing and engages with said bushing prior to the at least one plunger engaging with and into the at least one mold cavity when said tamperhead is moved towards said vibratable mold, an end portion of the guiding element being beveled allowing the guiding element to be gradually positioned into the bushing when the beveled end makes contact with the side of the bushing; and wherein said guiding element and said bushing allow the vibratable mold to freely vibrate when the plunger is positioned in the vibratable mold.

2. The apparatus according to claim 1, wherein the engagement of said guiding element and said bushing moves said at least one plunger into substantial alignment with said at least one mold cavity.

3. The apparatus according to claim 1, wherein said guiding element comprises a pin configured for insertion into said bushing.

4. The apparatus according to claim 3, wherein the pin comprises:

a self-guiding nodule;

a neck portion; and a base portion.

5. The apparatus according to claim 1, wherein said guiding element comprises a wedge configured for insertion into said bushing.

6. The apparatus according to claim 1, wherein said bushing includes a chamfered edge.

7. The apparatus according to claim 1, wherein the at least one plunger includes at least one stripper shoe of substantially the same size and shape as the at least one mold cavity.

8. The apparatus according to claim 1, wherein said guiding element is removably attached to one of said tamperhead and said vibratable mold.

9. The apparatus according to claim 1, wherein said bushing is removably attached to one of said tamperhead and said vibratable mold.

10. A method for producing molded products, the method comprising the steps of:

moving a tamperhead having at least one plunger towards a vibratable mold having at least one mold cavity;

engaging a wearable, replaceable guiding element attached to one of the tamperhead and the vibratable mold with a wearable, replaceable bushing attached to the other of the tamperhead and the vibratable mold; and engaging the at least one plunger with and into the at least one mold cavity when the tamperhead is moved towards the vibratable mold;

wherein the step of engaging the guiding element with the bushing occurs prior to the step of engaging the at least one plunger with and into the at least one mold cavity, and wherein the guiding element aligns the guiding element with the bushing so that the at least one plunger is positioned into substantial alignment with the at least one mold cavity of the vibratable mold, an end portion of the guiding element being beveled allowing the guiding element to be gradually positioned into the bushing; and wherein said guiding element and said bushing allow the vibratable mold to freely vibrate when the plunger is positioned in the vibratable mold.

* * * * *

UNITED STATES PATENT AND TRADEMARK OFFICE

CERTIFICATE OF CORRECTION

PATENT NO. : 7,575,700 B2
APPLICATION NO. : 11/359770
DATED : August 18, 2009
INVENTOR(S) : Ishler It is certified that error appears in the above-identified patent and that said Letters Patent is hereby corrected as shown below:

Title Page, Item (73)-Assignee, change "Pampf Molds Industries, Inc." to
-- Rampf Molds Industries, Inc. --

Signed and Sealed this

Seventeenth Day of November, 2009

David J. Kappos

David J. Kappos
*Director of the United States Patent and Trademark Office*